United States Patent [19]

Frentzel et al.

[11] 4,008,587

[45] Feb. 22, 1977

[54] BICYCLE LOCK ASSEMBLY

[75] Inventors: Herman C. Frentzel, Shorewood; Thomas H. Frentzel, Whitefish Bay, both of Wis.

[73] Assignee: Frentzel Products, Inc., Milwaukee, Wis.

[22] Filed: Jan. 12, 1976

[21] Appl. No.: 648,145

[52] U.S. Cl. ..... 70/235; 70/56; 70/58; 211/5; 211/8; 211/18; 248/203

[51] Int. Cl.[2] ..... E05B 71/00; E05B 67/38

[58] Field of Search ..... 70/14, 15, 18, 19, 54, 70/55, 56, 57, 58, 59, 61, 62, 51, 53, 227, 233, 234, 235; 211/5, 8, 17, 18, 22; 248/203, 221 R, 221 A, 221 C, 221 D, 221 F

[56] References Cited

UNITED STATES PATENTS

| | | | |
|---|---|---|---|
| 650,592 | 5/1900 | Schroter | 70/234 |
| 654,402 | 7/1900 | King | 248/203 |
| 1,453,882 | 5/1923 | McHugh | 70/18 |
| 1,682,613 | 8/1928 | Greenlaw | 248/221 D X |
| 2,497,797 | 2/1950 | Rogers | 248/203 X |
| 2,975,998 | 3/1961 | Clift | 248/221 D X |
| 3,802,232 | 4/1974 | Mattson et al. | 70/234 |
| 3,805,564 | 4/1974 | Velardo | 70/233 X |
| 3,884,055 | 5/1975 | Vuillemot | 70/58 |
| 3,884,057 | 5/1975 | Maurer | 70/54 X |
| 3,931,919 | 1/1976 | Gerber et al. | 211/22 X |

FOREIGN PATENTS OR APPLICATIONS

| | | | |
|---|---|---|---|
| 755,301 | 9/1933 | France | 211/5 |
| 183,435 | 7/1906 | Germany | 70/234 |
| 493,309 | 10/1938 | United Kingdom | 70/227 |

*Primary Examiner*—Roy D. Frazier
*Assistant Examiner*—Thomas J. Holko
*Attorney, Agent, or Firm*—Quarles & Brady

[57] ABSTRACT

An assembly includes a face plate which is mounted to an exposed wall stud in an enclosure such as a garage. The ends of a U-shaped locking member formed from a bar of hardened steel extend through transverse openings in the face plate and encircle a portion of a bicycle frame. An eye is formed on one end of the locking member and a padlock is placed through the eye to prevent withdrawal of the locking member from the face plate. In a first embodiment of the invention the face plate is mounted to the exposed edge of the wall stud on the interior of the enclosure, and in a second embodiment the face plate is mounted to the outside surface of the wall defined by the wall stud.

8 Claims, 7 Drawing Figures

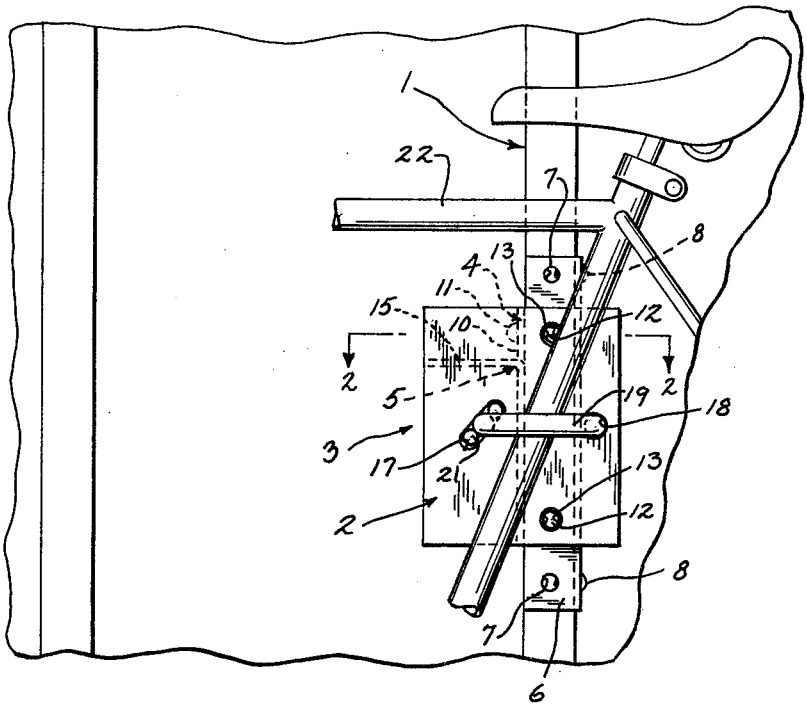
Fig.1
Fig.4
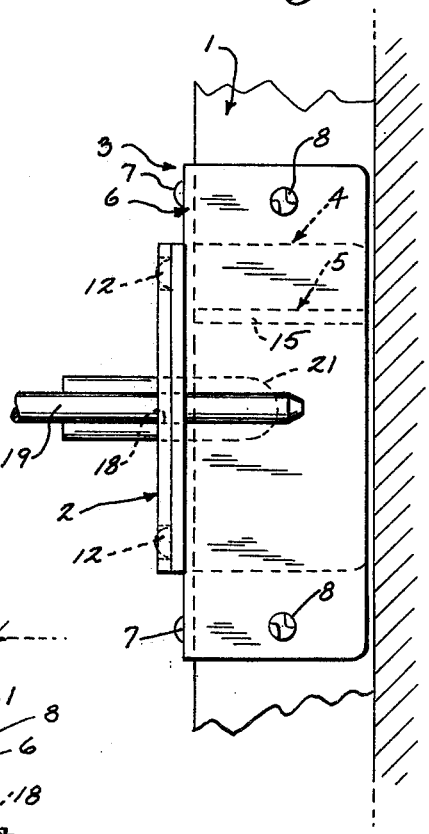
Fig.3
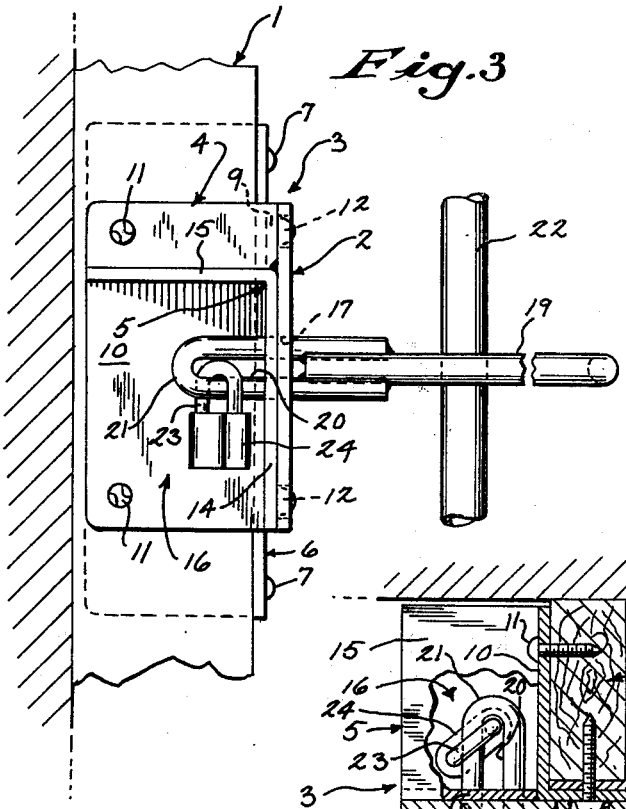
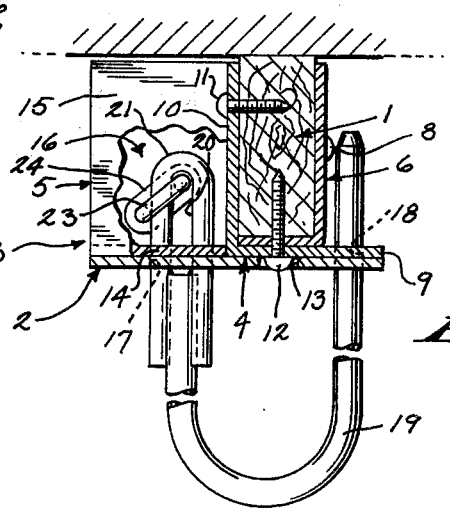
Fig.2

BICYCLE LOCK ASSEMBLY

BACKGROUND OF THE INVENTION

The field of the invention is locking devices, and particularly, devices for locking bicycles or motorized cycles when stored in a building.

Numerous devices are available for attaching and locking an unattended bicycle to a stationary object such as a bicycle stand or pipe. Such locks typically include a chain or other flexible cord which wraps around the stationary object and a portion of the bicycle structure to form a closed loop which is secured by a separate or an integral lock.

Storage of a bicycle in an enclosure such as a garage presents a number of substantial problems. First, the enclosure shields the intruder as well as the bicycle and thus allows him more time to defeat the locking mechanism. Cutting and prying tools can thus be employed with more effectiveness to cut the flexible cord or pry open the lock. Also, there is often no conveniently located pipe or other secure structure around which a conventional bicycle lock can be looped.

SUMMARY OF THE INVENTION

The present invention relates to a lock assembly for securing a bicycle or motorized cycle to an exposed wall stud. More specifically, the invention resides in a face plate mounted at the edge of the wall stud and a loop that extends outward from the plate to encircle a part of the bicycle and then back through the plate. An eye is formed in the end returning through the plate to receive a lock and thereby secure the bicycle to the stud.

In one preferred form, the face plate has a pair of laterally displaced openings through which the legs of a rigid, U-shaped locking member extend. An eye is formed on the end of one leg of the locking member and it is secured to the face plate by a lock which extends through the eye and inhibits withdrawal thereof through the opening. The bicycle is parked alongside the wall in front of the face plate and the U-shaped locking member forms a closed loop which links with a portion of the bicycle frame or wheel. Because most garages have exposed wall studs around their entire perimeter, the face plate can easily be mounted at a location which is convenient for storing a bicycle.

A general object of the invention is to provide improved security for unattended bicycles, motorized cycles and analogous devices. A rigid U-shaped locking member may be formed from a hardened steel which cannot be cut with commercially available cutters or saws. In addition, the face plate may be secured to the wall stud with steel mounting means which substantially encloses the wall stud on its three exposed surfaces immediately behind the face plate. The shield thus provided by the mounting means inhibits the use of cutting and prying tools on the wooden wall stud. Also, the lock is disposed behind the face plate where it is partially shielded.

Another object is to provide a lock assembly that is secured firmly to a fixed structure, so that a bicycle, or other locked device, cannot be carried away in a locked condition.

The foregoing and other objects and advantages of the invention will appear from the following description. In the description reference is made to the accompanying drawings which form a part hereof, and in which there is shown by way of illustration two preferred embodiments of the invention. Such embodiments do not necessarily represent the full scope of the invention, however, and reference is made to the claims herein for interpreting the breadth of the invention.

BRIEF DESCRIPTION OF THE DRAWINGS

FIG. 1 is a front elevation view of the first preferred embodiment of the invented lock system along with a portion of a bicycle secured thereby, FIG. 2 is a partial top view in cross section of a lock system of FIG. 1 taken along the line 2—2, FIG. 3 is a partial left side elevation view of the lock system of FIG. 1, FIG. 4 is a partial right side view of the lock system of FIG. 1.

DESCRIPTION OF THE PREFERRED EMBODIMENTS

Figure 5:
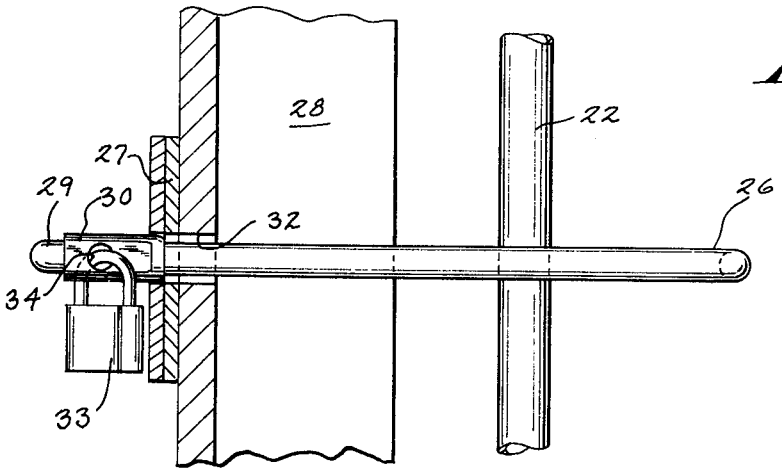
FIG. 5 is a side elevation view of a second preferred embodiment of the invented lock system.

Referring particularly to FIGS. 1–4, the first preferred embodiment of the invention is mounted to an exposed wall stud 1 in an enclosure such as a garage. The lock assembly includes a rectangular steel face plate 2 which is mounted across the front, exposed edge of the wall stud 1 in a position that is normal to the stud and with side areas extending to both the right and the left of the stud. The face plate 2 is part of a three-component assembly 3 comprised of the plate 2, an L-shaped base member 4 directly behind the plate 2, and a lock guard 5 nested behind the plate 2 and at one side of the base member 4.

A stud guard 6, which is a separate element from the assembly 3, is formed from sheet steel and is bent at a right angle to cover both the exposed edge of the wall stud 1 and its right side. A front web of the stud guard 6 is disposed behind the face plate 2 and extends a substantial distance above and below it. A side web of the stud guard 6 covers a substantial area of the right side of the wall stud 1 and extends rearward for nearly the entire width of the wall stud 1 so that cutting of the wall stud 1 by an intruder or thief along its length is substantially prohibited. The stud guard 6 is fastened to the wall stud 1 by a first pair of locking screws 7 which are received in the front edge of the wall stud 1, and a second pair of locking screws 8 which are received in its right side. The locking screws 7 and 8 are commercially available fasteners which can be turned clockwise to tighten the screw, but cannot be turned counterclockwise.

The base member 4 is also formed by making a right angle bend in a rectangular-shaped steel plate. The base member 4 thus includes a front web 9 which overlaps the stud guard 6 on the front edge of the wall stud 1, and a side web portion 10 which covers the left side of the wall stud 1 immediately behind the face plate 2. The base member 4, and hence, the entire assembly 3, is fastened to the wall stud 1 by a first pair of locking screws 11 which are received through openings in the side web 10 and a second pair of locking screws 12 which are received in openings formed in the front web 9.

The face plate 2 is securely welded to the front web 9 in a position that fully overlaps the front web 9 of the base member 4, and the front web 9 is co-terminus with the right hand side of the face plate 2 so that a double thickness giving greater rigidity and strength is achieved. Enlarged openings 13 are formed in the face plate 2 and are aligned to receive the heads of the locking screws 12. The openings 13 thus define countersunk regions which protect the heads of the locking screws 12 from prying and cutting instruments.

The mounting assembly 3 also includes the lock guard 5 which is formed by bending a steel plate at its middle. The lock guard 5 includes a front portion 14 which is welded to the back surface of the face plate 2 and which is coterminus with the left hand side of the face plate 2 to provide a double thickness, similarly as the front web 9 of the base member 4 on the right hand side. The lock guard 5 also has a top portion 15 which extends rearward at right angles to both the face plate 2 and the side web 10 of the base member 4. The top portion 15 constitutes a hood that is welded to the base member 4 and forms part of the integral assembly 3. The lock guard 5 thus serves not only to define a substantially enclosed cavity 16 beneath this hood, but also to significantly improve the strength of the mounting assembly 3 by further securing the face plate 2 to the base member 4. Any attempt to pry the face plate 2 from the wall stud 1 would require that both sets of locking screws 11 and 12 be ripped free, which would be extremely difficult in view of the fact they enter the wall stud 1 at right angles to one another.

A pair of openings 17 and 18 are formed in the face plate 2 and are positioned along a horizontal, or transverse, axis on opposite sides of the wall stud 1. These openings 17 and 18 receive the legs of a U-shaped bail 19 which is constructed from a bar of hardened steel. An eye 20 is formed on one leg of the bail by welding a small U-shaped steel bar 21 to its end. The opening 17 in the face plate 2 is elongated and slanted 45° from the vertical to receive the member 21. When inserted in the openings 17 and 18, the bail 19 forms a closed loop with the face plate 2 which encircles a portion of the bicycle from 22. The shackle 23 on a padlock 24 may be looped through the eye 20 and closed to lock the bicycle 22 in place. When thus locked, the padlock 24 is disposed within the cavity 16 beneath the lock guard 5, where it is protected from prying and cutting instruments.

The bail 19 may be modified by the substitution of a chain of hardened links. One end of the chain may be linked to the opening 18, and the other end may have a short leg, similar to the U-shaped bar 21 that is inserted through the opening 17. Or, an end link for the chain could be of sufficient length to be inserted through the opening 17 with an eye through which a padlock shackle could be inserted. By use of a chain the bicycle need not be aligned as precisely with the face plate 2, and by increasing the chain length more than one bicycle can be secured at a time. The chain may be sheathed in a plastic sleeve to eliminate scratching or abrasion of the bicycle, or the chain links can be individually coated with a resilient, rubber-like material. The bail 19 of FIGS. 1–4 may be similarly coated to avoid damage to the bicycle, and if desired the length of the bail 19 may be extended so that a number of bicycles can be placed side by side in front of the face plate 2 and looped, or locked together by passing the bail 19 around a frame member of each.

The embodiment of FIGS. 1–4 is characterized by having the metallic face plate 2 overlie the front edge of the wall stud 1, and the side webs of the stud guard 6 and base member 4 cover large areas of the stud side surfaces. A substantial part of the wall stud 1 is thus shielded by a metallic cover, such shielding extending for the depth of the stud 1, so that it becomes difficult to remove the lock assembly from the stud, or a part of the stud mounting the lock assembly from the building proper.

Figure 6:
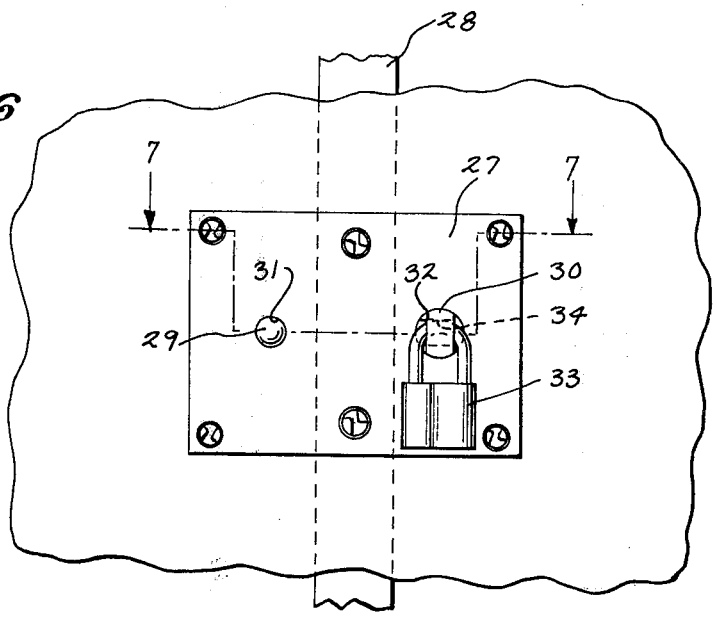
FIG. 6 is a front elevation view of the lock system of FIG. 5.
Figure 7:
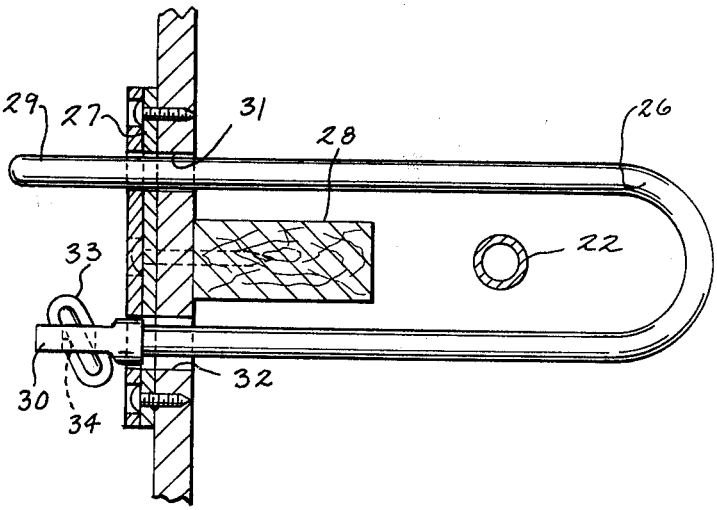
FIG. 7 is a top view of the lock system of FIG. 5.

Referring to FIGS. 5, 6 and 7, a second preferred embodiment of the invention includes a U-shaped locking member, or bail, 26 similarly constructed from a bar of hardened steel. A laminate face plate 27 of two steel sheets welded together is mounted to the exterior surface of the wall defined by a wall stud 28 and the legs 29 and 30 on the bail 26 extend through openings 31 and 32 from the interior of the building. The openings 31 and 32 are disposed on opposite sides of the wall stud 28 along a transverse axis and the bail 26 loops around the wall stud 28 to form a closed loop which encircles a portion of the bicycle frame as described above. A padlock 33 passes through an eye 34 formed on the end of the leg 30 to secure the bail 26 in place.

The face plate 27 is secured in place by a set of six mounting screws 35, and similarly as for screws 12 in FIG. 2 the openings for the screws 35 are countersunk to recess the screwheads. If desired, a hood can be mounted on the face plate 27 that shrouds the padlock 33 to protect it from the elements and to make tampering more difficult. Although the padlock 33 is not in a building interior in the second preferred embodiment of the invention, it is disposed where it can be easily observed. An intruder thus cannot find shelter from observation if he attempts to force the lock 33.

The invention thus provides a bicycle lock assembly that couples a face plate to a wall stud, or similar upright, and securely attaches a steel loop to the plate that links part of the bicycle. It is constructed in such fashion that thieves and others are substantially thwarted in their attempts to separate the bicycle from the lock mechanism and the stud or upright to which it is attached. The loop is preferably a hardened steel bar bent to the desired configuration, but other forms such as hardened chain may be employed. Particularly with a steel bar, the bicycle is held directly in front of the lock assembly, so that it becomes more difficult to tamper with the assembly, and it is a feature of the invention that the bicycle itself becomes a part of the locked assembly and makes it more difficult to tamper with it.

While the invention has been described in connection with a building stud, it is to be understood that the lock assembly can be attached to other suitable structures that present a firm anchorage. And, the assembly can be employed for securing other types of devices than bicycles or motorized cycles, such as mowers, lawn furniture and the like.

We claim:

1. A locking assembly, the combination comprising:

a face plate having a pair of laterally spaced openings;

means for mounting said face plate to a wooden wall stud having an exposed edge and a pair of sides, said mounting means includes a stud guard which is fastened to said stud to substantially cover a portion of its exposed edge and one of its sides, and a base member which fastens to said face plate and extends rearward therefrom to fasten to said stud and substantially cover its other side immediately behind said face plate, said face plate being positioned over and against the portion of said stud guard which covers the edge of the wall stud; and a rigid, U-shaped locking member having leg portions which extend through said spaced openings, one of said legs having an eye formed on its end, through which a lock may extend to inhibit the withdrawal of said locking member from said openings.

2. The lock assembly as recited in claim 1 in which said face plate extends transversely a substantial distance to either side of said wall stud and a lock guard is fastened to the rear surface thereof and extends rearward therefrom to fasten to said base member and to define a lock cavity therebeneath.

3. In a bicycle lock assembly for mounting on an exposed wall stud, the combination comprising:

a stud guard formed from a metal plate and fastened to the wall stud to substantially cover its exposed edge and one side over a substantial portion of its length;

a face plate formed from a metal plate and including a base member which fastens to its rear surface and extends perpendicular therefrom, said face plate being fastened to the exposed edge of the wall stud and overlapping the stud guard, and said base member being fastened to the other side of the wall stud;

a locking member having two legs which extend through openings in the face plate to form a closed loop which encircles a portion of the bicycle to be locked; and means for locking the legs in place to prevent their removal from said openings.

4. The bicycle lock assembly as recited in claim 3 in which an eye is formed on the end of one of said legs for receiving the hasp of a padlock which engages the back surface of the face plate to prevent said one leg from being withdrawn.

5. The bicycle lock assembly as recited in claim 4 in which a lock guard is fastened to the face plate and a base member and it extends in a substantially horizontal plane therefrom immediately above said padlock.

6. The bicycle lock assembly as recited in claim 4 in which said locking member is a rigid steel bar having a U shape and the openings which receive the legs thereof are disposed on opposite sides of said wall stud along a substantially horizontal axis.

7. In a lock assembly for mounting on an upright support, the combination comprising:

a face plate for extending across the front of said upright support;

shielding webs extending rearward from said face plate to overlie opposite side surfaces of said upright support;

a hood between said shielding web and said face plate forming a lock cavity behind said face plate; and an encircling loop extending forward from and then turning back toward said face plate, said loop having a leg with a locking eye that extends through said face plate to position said eye in said cavity.

8. In a lock assembly for mounting on an upright support, the combination comprising:

a guard member having a front portion for overlaying the front of said upright support and a side portion for overlaying a side of said upright support;

a base member having a front web overlying said front portion of said guard member and having a side web for overlaying a side of said upright support opposite said side portion of said guard member;

a lock guard having a front portion co-planar with said front web of said base member, and a hood portion along-side said side web of said base member;

a face plate overlying said base member front web and said lock guard front portion; and a loop member cooperatively engaged with said face plate extending outward therefrom and looping back to said face plate with an eye at one end inserted through said face plate to receive a lock at the rear of said face plate beneath said hood.

* * * * *